United States Patent [19]

Beitner

[11] 4,350,016

[45] Sep. 21, 1982

[54] DEVICE AND PROCESS FOR EFFECTING REFRIGERATION

[75] Inventor: Shlomo Beitner, Tel-Aviv, Israel

[73] Assignee: Bipol Ltd., Tel-Aviv, Israel

[21] Appl. No.: 236,523

[22] Filed: Feb. 20, 1981

[51] Int. Cl.[3] ..... F25B 21/02

[52] U.S. Cl. ..... 62/3

[58] Field of Search ..... 62/3

[56] References Cited

U.S. PATENT DOCUMENTS

| | | | |
|---|---|---|---|
| 2,886,618 | 5/1959 | Goldsmid | 62/3 X |
| 2,931,188 | 4/1960 | Levit | 62/3 |
| 3,008,299 | 11/1961 | Sheckler | 62/3 |
| 3,008,300 | 11/1961 | Ryan et al. | 62/3 |
| 3,154,926 | 11/1964 | Hirschhorn | 62/3 |
| 3,212,274 | 10/1965 | Eidus | 62/3 |
| 3,216,205 | 11/1965 | Milligan et al. | 62/3 |
| 3,740,959 | 6/1973 | Foss | 62/3 |
| 3,874,183 | 4/1975 | Tabet | 62/3 |
| 4,055,053 | 10/1977 | Elfving et al. | 62/3 |

*Primary Examiner*—Lloyd L. King

*Attorney, Agent, or Firm*—Gordon W. Hueschen

[57] ABSTRACT

There is described a device and process for effecting refrigeration by means of a thermoelectric element having a hot face and a cold face, which is powered by impressing a direct current across the faces, and in which the heat transferred to the hot face is dissipatead into an external thermal sink which is cooled by applying water to a surface thereof concomitantly with the exposure of that surface to ambient atmosphere. The thermal sink comprises a capillary metal sponge into which the water is absorbed on the capillary surfaces and evaporated while the sponge is exposed to the ambient atmosphere, whereby cooling is effected, both by direct heat transfer into said gaseous medium and by vaporization of said liquid.

10 Claims, 3 Drawing Figures

DEVICE AND PROCESS FOR EFFECTING REFRIGERATION

FIELD OF INVENTION AND PRIOR ART

This invention relates to a device and process for effecting refrigeration by means of a thermoelectric element having a hot face and a cold face activated by imposing a direct current potential across the faces thereof, wherein the hot face is cooled by conducting heat into an extraneous medium.

In U.S. Pat. No. 4,107,934 and in the patents cited therein during the prosecution thereof, there are shown portable refrigerator units powered by a thermoelectric element actuated by a direct current potential, such as can be obtained from a car, boat, or like vehicle. Such portable units, have the disadvantage, however, that the cooling is limited by the rate at which the heat is dissipated into the ambient medium.

OBJECTS OF THE INVENTION

It is an object of the invention to provide a device of the class described having increased capacity to dissipate heat. Another object of the invention to provide a device and process of the class described in which part of the heat generated is dissipated into the heat of vaporization of a vaporizable liquid and part is dissipated into the enveloping medium. Further objects of the invention are to avoid the disadvantages of the prior art and to obtain such advantages as will appear as the description proceeds.

BRIEF DESCRIPTION OF THE INVENTION

The invention is directed to a device and process of the class described wherein the heat is conducted by means of a thermal sink, one face of which is in direct heat transfer with the hot face and the other face of which is in direct heat transfer with an enveloping ambient, gaseous medium and in which a vaporizable liquid is applied to the other face concomitantly with it being exposed to the ambient, gaseous medium, whereby cooling is effected, both by direct heat transfer into said gaseous medium and by vaporization of said liquid.

Advantageously, the vaporizable liquid is absorbed into a capillary metal sponge, one part of which is exposed to the ambient, gaseous medium and another part of which is in direct heat transfer contact with the other face of the thermal sink. By exposing the metal sponge both to a vaporizable liquid and to the ambient, gaseous medium, the liquid is absorbed on the capillary surfaces of the sponge and evaporated therefrom into the ambient, gaseous medium, whereby cooling by the combined effect of the heat of vaporization of the liquid and by heat transfer into the gaseous medium is obtained.

DETAILED DESCRIPTION OF THE INVENTION

Figure 1:
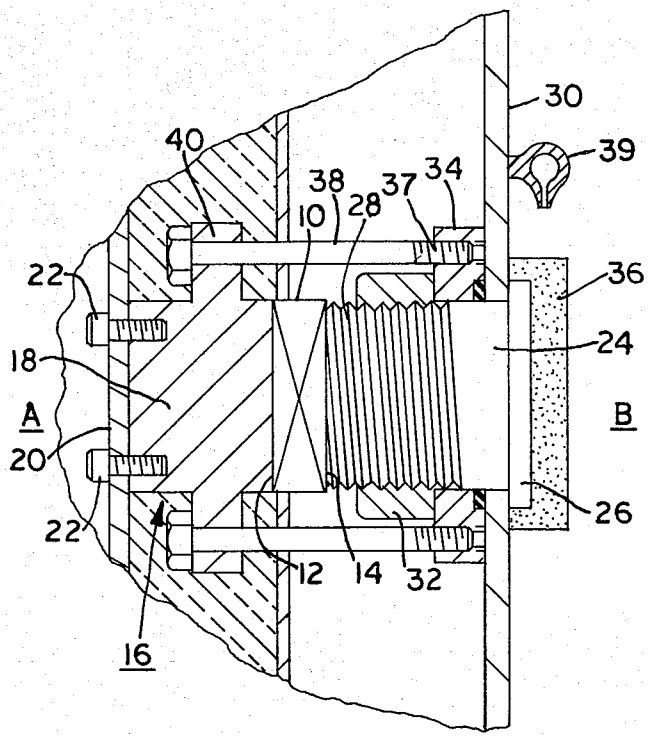
FIG. 1 is a cross-sectional view in side elevation of one form of the invention.

FIG. 1 is a partial view of a wall of a device in which heat is to be transferred from area A to an enveloping ambient, gaseous medium B. The motivating force for the heat transfer is a thermoelectric element 10 which is operative when a direct potential is impressed across faces 12 and 14 thereof, when the polarity is right, to cause the face 12 to become cold and the face 14 to become hot. The cold face 12 is in direct heat-transfer contact with a thermal sink 16 composed of a solid body 18 of suitable heat-conducting material, for example, aluminum, and a liner 20 of like material fastened thereto by bolts 22, or the like. The hot face 14 is in direct heat-transfer contact with an external sink 24 of like heat-conducting material.

The external thermal sink 24 comprises a head 26 and a threaded portion 28 so that it can be inserted through a hole in wall 30 and fastened thereto by nut 32. Between the nut 32 and the wall 30 is interposed a washer 34 having threaded bores therein to receive the threaded ends 37 of bolts 38 which extend through wings 40 on the internal thermal sink 18 so that the assembly can be bolted together to place the thermoelectric element 10 in compression between the internal thermal sink 18 and the external sink 34.

The head 26 has fused thereto, or otherwise in direct heat-contact therewith, a porous metal sponge 36.

Fastened to the wall 30 is a spray head 39 arranged to spray water or like vaporizable liquid onto the metal sponge 36. It will, of course, be understood that the spray head 39 can be arranged to spray the liquid on the face of the metal sponge 36, or to spray it on the top thereof, as shown. Also, it is to be understood tha the spray head 39 can be arranged to drip water onto the metal sponge 36.

However arranged, the essential feature is that a vaporizable liquid is applied to the metal sponge so that it can be absorbed into the capillaries thereof concomitantly with the metal sponge being exposed to the ambient air or like gaseous medium B. Thus, the heat transferred by the thermoelectric element into the external thermal sink causes the absorbed liquid to be vaporized into the ambient, gaseous medium so that cooling is effected, both by direct heat transfer into the ambient, gaseous medium and by transfer into heat of vaporization of the liquid.

Figure 2:
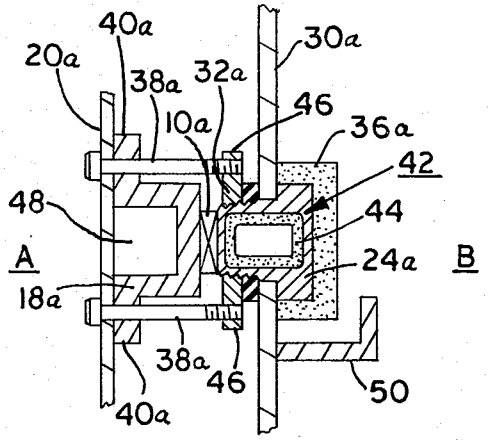
FIG. 2 is a cross-sectional view in side elevation of another form of the invention.

FIG. 2 illustrates a modification in which the external thermal sink 24 comprises a heat pipe 42 comprisng a cavity in the heat sink 24 lined with a capillary sponge 44 and partially filled with a vaporizable liquid having a boiling point such that it is condensed at the outer end of the heat pipe, conducted to the inner end by capillary action, and vaporized there to complete a cycle in which heat is transferred from one end to the other, at least in part by the heat of vaporization of liquid in the heat pipe.

In the modification in FIG. 2, the nut **32*a* has wings 46 into which are threaded bolts 38*a*. These bolts pass through the liner 20*a* and wings 40*a* in the internal thermal sink 18*a*. Thus, by tightening up the bolts 38*a*, the thermoelectric element 10*a* is placed under compression between the internal thermal sink 18*a* and the external thermal sink 24*a*, and the whole unit is thus secured to the wall 30*a***.

The internal thermal sink **18*a* is constructed as a channel-shaped member in which the cavity 48 can be adjusted in size to determine the heat sink capability of the heat sink 18***a*.

Affixed to the wall 30*a* is a trough 50 for holding an intact body of water or liquid in contact with the bottom portion of the metal capillary sponge 36*a*. Thus, water is drawn up from the trough 50 into the metal sponge 36*a* by capillary action where it is evaporated by the heat transferred from A and thus dissipated into the ambient atmosphere B.

Figure 3:
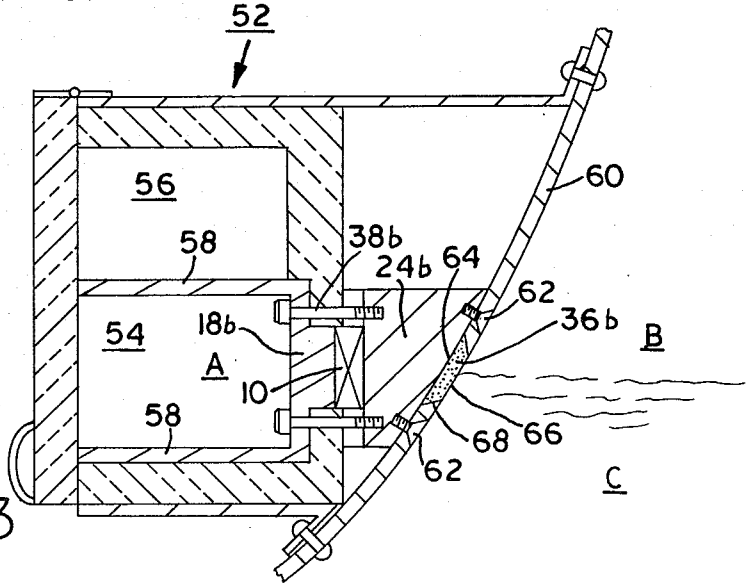
FIG. 3 is a cross-sectional view in side elevation of still another form of the invention.

FIG. 3 illustrates a modification of the invention in which the device is designed for cooling a refrigerator in a boat, or like watercraft. In this modification, the refrigerator 52 comprises a freezing compartment 54 and a cooling compartment 56. The walls 58 are formed as integral extensions of the internal thermal sink 18*b* which is fastened to the external thermal sink 24*b* by bolts 38*b* which place the thermoelectric element 10*b* in compression between the internal thermal sink 18*b* and the external thermal sink 24*b*.

The external thermal sink 24*b* is fastened to the hull 60 of a watercraft by means of screws 62. Inset in the hull 60 is a capillary metal sponge 36*b* having its inner face 64 in direct heat-transfer contact with the external thermal sink 24*b* and its outer face 66 exposed in part to the ambient atmosphere B and the ambient water C.

The edges 68 of the sponge 36*b* are beveled, as are the corresponding edges of the aperture in the hull 66, so that the sponge 36*b* is retained when the outer face of the external thermal sink is drawn up tight against the inner face 64 of the sponge 36*b* by the screws 62. In this construction, it is not necessary to have the sponge 36*b* fused or otherwise secured to the external thermal sink 24*b*, although it is to be understood that this can be done, if desired.

It will be understood that, in the practice of the invention, it is not necessary to have the metal sponge 36*b* located at the water level, as shown in FIG. 3 because, if it is located substantially above the water level, it still will be wetted by the water due to the lapping of the waves against the hull, both when riding at anchor and when traveling.

It will be understood, also, that in the broader aspects of the invention, the capillary metal sponge can be omitted and the water sprayed or splashed directly on the exposed surface of the external thermal sink. A marked improvement in the efficiency of the device is obtained, however, by use of the capillary metal sponge, as illustrated and described.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. In a device enveloped by an ambient, gaseous medium, a process for effecting refrigeration therein by means of a thermoelectric element having a hot face and a cold face activated by imposing a direct current potential across said faces, wherein said hot face is cooled by conducting heat therefrom into said ambient, gaseous medium, the improvement in which the heat is conducted by means of a thermal sink, one face of which is in direct heat-transfer contact with said hot face and the other face of which is in direct heat-transfer contact with said ambient, gaseous medium, and in which a vaporizable liquid having a high latent heat of vaporization is applied to said other face concomitantly with it being exposed to said ambient, gaseous medium, said liquid being so applied that cooling is effected, both by direct heat transfer into said gaseous medium and by vaporization of said liquid, whereby advantage is taken of the high latent heat of vaporization of the vaporizable liquid.

2. In a device enveloped by an ambient, gaseous medium, a process for effecting refrigeration therein by means of a thermoelectric element having a hot face and a cold face activated by imposing a direct current potential across said faces, wherein said hot face is cooled by conducting heat therefrom into said ambient, gaseous medium, the improvement in which the heat is conducted by means of a thermal sink, one face of which is in direct heat-transfer contact with said hot face and the oter face of which is in direct heat-transfer contact with said ambient, gaseous medium, and in which a vaporizable liquid is applied to said other face concomitantly with it being exposed to said ambient, gaseous medium, whereby cooling is effected, both by direct heat transfer into said gaseous medium and by vaporization of said liquid, and in which said vaporizable liquid is absorbed into a capillary metal sponge which is in direct heat-transfer contact with both said other face and said ambient, gaseous medium.

3. The process of claim 2, in which the vaporizable liquid is sprayed onto said metal sponge.

4. The process of claim 2, in which the vaporizable liquid is applied to at least one edge of said metal sponge.

5. In a device for effecting refrigeraton by means of a thermoelectric element having a hot face and a cold face activated by imposing a direct current potential across said faces, wherein said hot face is cooled by conducting heat therefrom into an ambient, gaseous medium, the improvement which comprises means for applying a vaporizable liquid having a high latent heat of vaporization to the other face of said thermal sink concomitantly with it being exposed to said ambient, gaseous medium, said means applying said liquid in such a manner that cooling is effected, both by direct heat transfer into said gaseous medium and by vaporization of said liquid, whereby advantage is taken of the high latent heat of vaporization of the vaporizable liquid.

6. In a device for effecting refrigeration by means of a thermo-electric element having a hot face and a cold face activated by imposing a direct current potential across said faces, wherein said hot face is cooled by conducting heat therefrom into an ambient, gaseous medium, the improvement which comprises means for applying a vaporizable liquid to the other face of said thermal sink concomitantly with it being exposed to said ambient, gaseous medium, whereby cooling is effected, both by direct heat transfer into said gaseous medium and by vaporization of said liquid, and which further comprises a capillary metal sponge having one face in direct heat-transfer contact with said hot face and another face, at least in part, exposed to said ambient, gaseous medium and means for causing said vaporizable liquid to be absorbed into said metal sponge.

7. The device of claim 6, in which said means comprises a spray head for directing a spray of said liquid onto said sponge.

8. The device of claim 6, in which said means comprises an arrangement in which said metal sponge is partially emersed in said liquid.

9. A process of claim 1, in which, in which said vaporizable liquid is absorbed into a capillary absorbent material which is in direct heat-transfer contact with both said other face and said ambient, gaseous medium.

10. A process of claim 1, in which said vaporizable liquid is water.

* * * * *

UNITED STATES PATENT AND TRADEMARK OFFICE

CERTIFICATE OF CORRECTION

PATENT NO. : 4,350,016

DATED : September 21, 1982

INVENTOR(S) : Shlomo Beitner

It is certified that error appears in the above-identified patent and that said Letters Patent is hereby corrected as shown below:

Col. 2, line 35; "tha" should read -- that --
Col. 4, line 14; "oter" should read -- other --

Signed and Sealed this

*Eleventh* Day of *January 1983*

[SEAL]

*Attest:*

GERALD J MOSSINGHOFF

*Attesting Officer* *Commissioner of Patents and Trademarks*